United States Patent [19]

Barville et al.

[11] 4,096,977

[45] Jun. 27, 1978

[54] DEVICE FOR ANCHORING BOTTLES OR THE LIKE, AND METHOD

[76] Inventors: George W. Barville, 268 Sheffield La., Glen Ellyn, Ill. 60137; Joel R. Peterson, Sr., 5542 S. Natoma, Chicago, Ill. 60638

[21] Appl. No.: 717,345

[22] Filed: Aug. 24, 1976

[51] Int. Cl.[2] ..... A45F 3/14

[52] U.S. Cl. ..... 224/5 BC; 2/DIG. 6; 24/265 AL; 224/5 W; 248/102

[58] Field of Search ..... 224/5 R, 5 BC, 5 W, 224/45 AA, 58, 2 D, 2 E, 2 F, 3; 248/102, 103, 104; 2/DIG. 6, 340; 24/3 R, 3 F, 3 K, 3 M, 73 A, 73 C, 225, 265 R, 265 AL, 265 CC, 265 WS, DIG. 4

[56] References Cited

U.S. PATENT DOCUMENTS

| | | | |
|---|---|---|---|
| 748,282 | 12/1903 | Jenkins | 24/73 C |
| 1,646,975 | 10/1927 | Newman | 2/340 X |
| 2,050,841 | 8/1936 | Houghton | 224/5 W X |
| 2,303,728 | 12/1942 | Drayton | 248/104 |
| 2,877,833 | 3/1959 | Boles | 224/5 BC X |
| 3,046,045 | 7/1962 | Campbell | 294/74 |
| 3,057,354 | 10/1962 | Roberts | 2/DIG. 6 |
| 3,087,277 | 4/1963 | McCook | 224/5 BC X |
| 3,089,143 | 5/1963 | Jacobson | 224/5 BC X |
| 3,144,230 | 8/1964 | Brooks | 224/5 W X |
| 3,428,029 | 2/1969 | Klickstein | 224/5 BC X |
| 3,797,715 | 3/1974 | Scialdone | 224/5 BC X |
| 3,977,638 | 8/1976 | Woodward | 224/5 W X |

FOREIGN PATENT DOCUMENTS

| | | | |
|---|---|---|---|
| 1,460,045 | 1/1970 | Germany | 2/340 |

*Primary Examiner*—Trygve M. Blix
*Assistant Examiner*—Winston H. Douglas
*Attorney, Agent, or Firm*—Hill, Gross, Simpson, Van Santen, Steadman, Chiara & Simpson

[57] ABSTRACT

A device especially suitable for, but not limited to, anchoring a baby bottle to a harness, and comprising an elongate flexible element having an eye with an eyehole at one end and a resiliently flexible retaining ring of larger diameter than the eyehole, the ring being adapted to encircle a portion of the flexible element and being compressible to small enough elongated dimension to pass through the eyehole to draw the encircled portion as a loop through the eyehole and then expand whereby to couple the ring to the flexible element, the eye engaging as a locking collar about the flexible element adjacent to the loop to substantially lock the ring against escape from the loop.

The device may comprise a baby bottle harness, and is especially well adapted for quick change to accommodate retaining of objects such as baby bottles of different sizes.

10 Claims, 7 Drawing Figures

DEVICE FOR ANCHORING BOTTLES OR THE LIKE, AND METHOD

The present invention relates to a device for anchoring bottles or the like and a method for assembling the device, and is more particularly concerned with devices especially suitable for anchoring a baby bottle directly on an infant.

Numerous and varied baby bottle harnesses have been proposed, some of which are adapted to be worn as a convenience by a person feeding a baby nursing from a bottle. Other harnesses are adapted to anchor a bottle to a baby's crib or a stand, and yet others have been proposed to be worn by the baby. In all instances, the infant has been to maintain the bottle within the baby's grasping range, it being well known, of course, that infants are clumsy and inept in grasping and retaining objects of interest, and more particularly nursing bottles. Representative of U.S. Pat. Nos. relating to this general field are 2,199,869; 2,631,288; 2,970,729; 3,543,976; and 3,635,430.

Among problems that have been experienced with prior devices have been sometimes complex structure, sometimes lack of adaptability for different sizes of bottles, sometimes lack of security of anchorage of the bottle in the device, and in general excessive cost and complex manipulative steps needed to effect assembly.

Another disadvantage of the prior devices or lack of provision in prior devices has been in the area of harnessing the bottle directly to the infant so that it will remain with the infant whether in a crib, or while being transported, and will not slip or become displaced or become separated from the infant. We are not presently aware of any prior harness that will overcome these deficiencies in respect to nursing bottle retainers, although various fairly efficient bib structures are known such as may have body encircling bands and cross-over shoulder straps employing buttons for attachment but which have no means for accommodating a nursing bottle.

An important object of the present invention is to provide a new and improved device especially suitable for anchoring a baby bottle or the like in a desired position of accessibility and which will overcome the disadvantages, deficiencies, inefficiencies, shortcomings and problems inherent in the prior art devices.

Another object of the invention is to provide a new and improved simple, inexpensive, efficient device which may include a harness, for retaining a bottle in place with respect to a nursing infant.

A further object of the invention is to provide a new and improved method of assembling a device especially, but not exclusively, suitable for anchoring a baby bottle in place.

Still another object of the invention is to provide a new and improved baby bottle or the like anchoring device of simple construction, low cost, and utmost efficiency.

According to features of the invention there is provided a device especially suitable for anchoring a baby bottle or the like, comprising an elongate flexible element having an eye with an eyehole therein at one end of the flexible element, and a resiliently flexible retaining ring of larger diameter than the eyehole, the ring being adapted to encircle a portion of the flexible element and being compressible to small enough elongate dimension to pass through the eyehole, similarly as a needle pulls a thread through a hole in a piece of fabric and thereby drawing the encircled portion as a loop through the eyehole and the ring then expanding, and said eye engaging as a ring retaining locking collar about said flexible element adjacent to the loop whereby to couple the ring to the element.

According to other features of the invention, there is provided a method of assembling such a device.

According to other features of the invention, there is provided a device especially suitable for anchoring a baby bottle or the like at the front of an infant, comprising a body encircling harness band having opposite end portions provided with means for releasably coupling such end portions together at the back of the band, a pair of shoulder straps having first ends attached to the front portion of the band in spaced relation at respectively opposite sides of the longitudinal center at the front of the band, means on second end portions of the shoulder straps for coupling them to the end portions at the back of the band, and an anchoring device comprising an elongate flexible element connected to substantially said longitudinal center of the front of the band between the first end portions of the shoulder straps and having means for retaining a baby bottle or the like.

Other objects, features and advantages of the invention will be readily apparent from the following description of a representative embodiment thereof, taken in conjunction with the accompanying drawing although variations and modifications may be effected without departing from the spirit and scope of the novel concepts embodied in the disclosure and in which.

Figure 1:
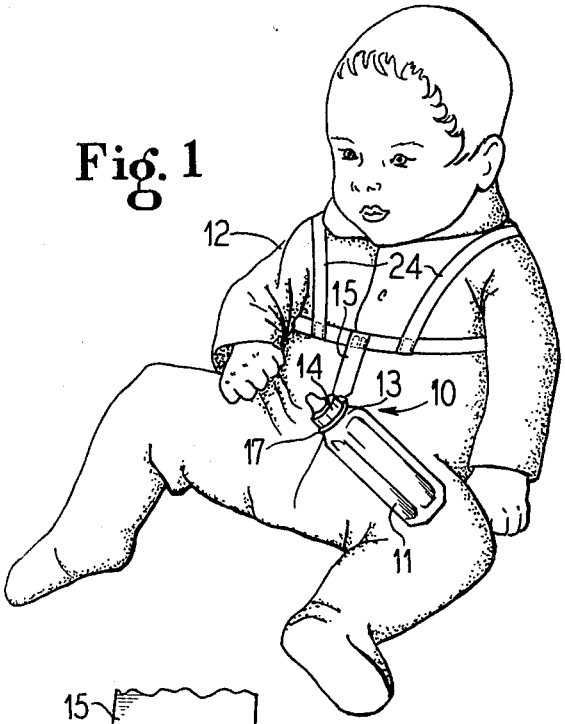
FIG. 1 is a front perspective view of a device exemplifying features of the invention, applied to a nursing infant for retaining a baby bottle in place.

Although it will be apparent that a device 10 embodying features of the invention may be used for anchoring or retaining various and sundry objects, an important utility resides in anchoring a baby bottle 11 (FIGS. 1 and 2) in association with a nursing infant 12 in a position for ready manipulation, at will, by the infant. Such a bottle, as is well known, has a reduced diameter neck 13 defining its open end and suitably equipped for retaining cooperation with the attachment flange annulus of a rubber nipple 14 which annulus, as is well known, is stretched over and elastically grips and is retained on the usually beaded bottle neck. On the other hand, the nipple may be of a screw-on type, if preferred. In any event, after the nipple 13 is on the bottle neck, there is customarily a clearance between the inner end of the nipple structure and the necked end portion of the bottle.

Figure 3:
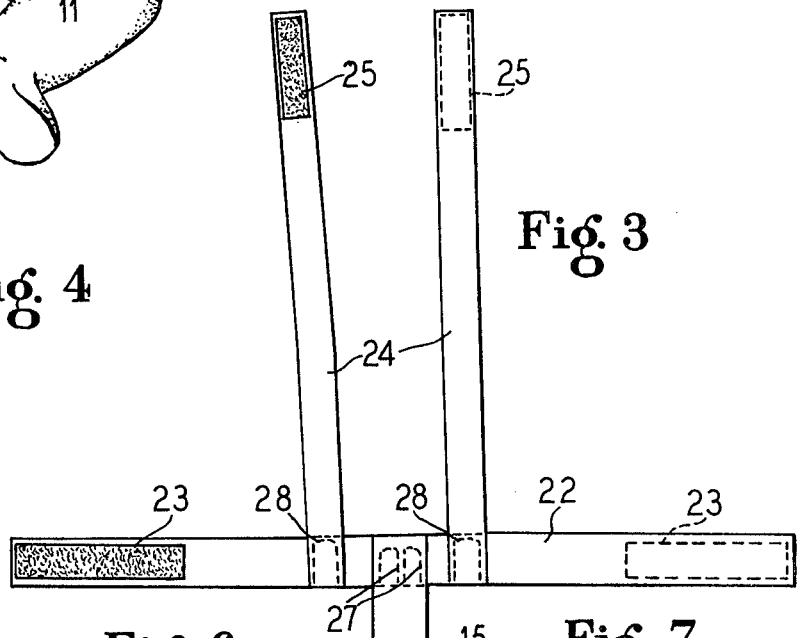
FIG. 3 is a plan view of the device showing it as a kit showing different sizes of retaining rings which may be used interchangeably in the assembly.

According to the present invention, the device 10 comprises an elongate flexible element 15 to which is coupled a resiliently flexible retaining ring 17. In the illustrated example, the ring 17 is dimensioned to engage retainingly with the bottle 11 in the clearance gap between the inner end of the nipple 14 and the necked end portion of the bottle which defines, for this purpose, a convenient ring-receiving attachment groove. Because bottle necks vary in diameter, most generally in two different sizes according to current practice, the retaining ring 17 should be appropriately selected for the size neck of the particular bottle 11 to be anchored. As represented in FIG. 3, the ring 17 may be of either a size to accommodate the smallest bottle neck size or may be larger to accommodate the larger bottle neck size, and where the device is sold as a kit to be assembled by the user, the kit may include both sizes of the ring 17.

Figure 4:
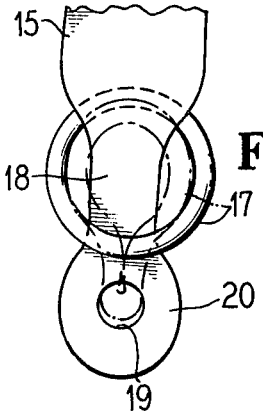
FIG. 4 is an enlarged fragmentary view demonstrating steps in assembling one of the retainer rings of the device in the assembly.
Figure 5:
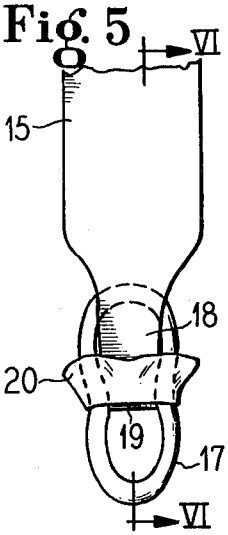
FIG. 5 is a similar view illustrating another step in effecting assembly of the ring.
Figure 6:
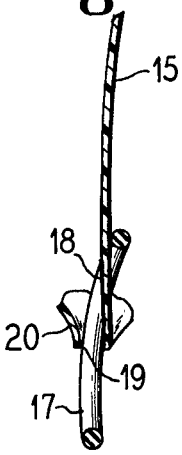
FIG. 6 is a vertical sectional view taken substantially along the line VI—VI of FIG. 5.
Figure 7:
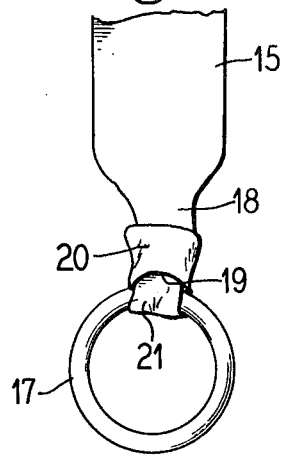
FIG. 7 is a front elevational view showing the ring for reassembly with the flexible anchoring element with which associated.

To facilitate easy assembly, or disassembly, for sanitary or interchangeability purposes (as where it is necessary to exchange one size of ring for another size of ring where the user is equipped with bottles of different neck sizes) a unique, simple and easily understood and manipulatable coupling between the flexible element 15 and the ring 17 is provided. To this end, the flexible element 15 has a neck portion 18 which is adapted to be received through and encircled by the ring 17 as is shown in FIG. 4. By compressing the ring 17 as shown in dot-dash outline in FIG. 4 to a small enough elongated dimension, the ring while encircling the neck portion 18 can be passed through a suitably dimensioned eyehole 19 in an eye terminal 20 of the element 15, in a generally similar fashion as a thread is passed through the eye of a needle and the needle then pulls the thread through a hole in a piece of fabric. By then pulling the compressed ring 17 through the eyehole 19, substantially as demonstrated in FIGS. 5 and 6, the neck portion 18 of the flexible element 15 pulls a loop 21 (FIG. 7) of the neck portion 18 through the eyehole 19. The ring 17 is then permitted to expand and the eye 20 engages as a ring-retaining locking collar about the flexible element 15, and more particularly the neck 18, adjacent to the loop 21 whereby the collar substantially locks the ring in the loop 21 to complete coupling of the ring to the flexible element 15. Since the eyehole 19 is substantially smaller in diameter than the ring diameter, it will be apparent that the ring 17 will remain positively coupled to the flexible element 15, until by reverse procedure the ring is uncoupled. In such reverse uncoupling releasing procedure, the ring 17 is again compressed to small enough elongate dimension to pass in reverse through the eyehole 19 and then drawn through the eye to pull the loop 21 through the eye and thus release the ring to be withdrawn from the element 15.

In a desirable construction for baby bottle anchoring, the flexible element 15 is adapted to be secured at its end opposite to the eye terminal 20 to the front of a body encircling harness band 22. In a preferred construction, the body band 22 has separable connector means at its opposite end portions for adjustably connecting the body band about the chest area of the infant 12. For this purpose, Velcro tape strips 23 are fixedly carried by the opposite end portions of the band 22, one of the strips being the loop portion of the fastener and the other of the strips being the hook portion of the fastener, one of the strips being attached to the outer face of the band 22 and the other of the strips being attached to the inner face of the band so that after the body band 22 has been brought into encircling relation to the infant 12, the fastener strips can be pressed together into retaining relationship at the back of the band.

Figure 2:
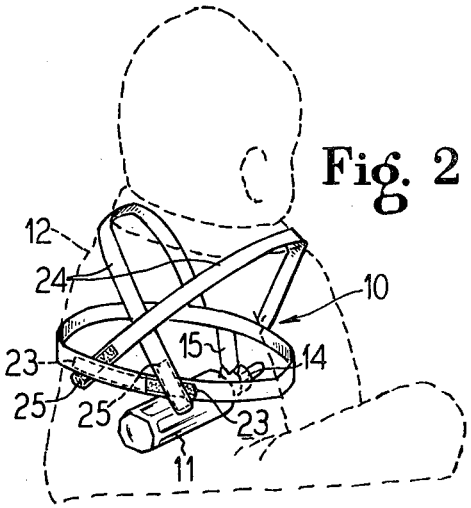
FIG. 2 is a rear perspective view of the device.

In this instance, the flexible anchoring element 15 is secured to substantially the longitudinal center at the front of the band 22 between spaced shoulder straps 24 which have ends secured to the front of the band 22 adjacent to but in limited spaced relation to the attached end of the flexible element 15. On their free end portions, the shoulder straps 24 have separable fastening means in the form of Velcro tape strips 25 complementary to the fastener strips 23 on the body band 22, and so arranged that after the body band 22 has been secured about the infant 12, and the shoulder straps brought over the infant's shoulders and crossed at the back, substantially as shown in FIG. 2, the loop portion of the strips 25 can be pressed into engagement with the hook portion of the strips 23, and the hook portion of the strips 25 can be pressed into retaining engagement with the loop portion of the strips 23 in a longitudinally adjusted relation, the fastener strips 23 being long enough so that after fastening to the proper adjusted size, there will be ample areas of the fastener strips 23 exposed to receive and releasably retain the fastener strips 25 on the shoulder straps 24.

Although the flexible element 15, the body band 22 and the shoulder straps 24 may be constructed from any suitable strip, strapping, ribbon or the like of fabric or combination fabric and plastic, a suitable material comprises vinyl webbing of about 1½ inch width for the flexible element 15 and the body band 22 and similar webbing of about 1 inch width for the shoulder straps 24. This material has the advantage that it is easily maintained in a sanitary condition and that the parts can be secured together by electronic welding, such electronic welding 27 being indicated for the securement of the flexible element 15 to the body band 22, and such electronic welding 28 being indicated for securing the shoulder straps 24 to the body band 22. In addition, since the Velcro fastener material is formed from electronically weldable plastic, the fastener strips 23 and 25 can be and desirably are secured to their respective members by electronic welding. This greatly faciliates and simplifies securing the assembled flexible element 15, body band 22 and shoulder straps 24 in the assembly. The inherent flexibility of the relatively thin web material in the flexible element 15 facilitates the manipulative steps in the coupling assembly of the resiliently flexible, i.e., rubber, ring 17, or the uncoupling operation. Such vinyl webbing also has the desirable attribute of at least limited stretchability, further enhancing the coupling for uncoupling pullthrough of the ring 17 with respect to the eye terminal 20.

It will be understood that variations and modifications may be effected without departing from the spirit and scope of the novel concepts of the present invention.

We claim as our invention:

1. A device especially suitable for anchoring an object such as a baby bottle or the like to a body encircling harness, comprising:

an elongate flexible element having a neck portion and opposite ends, one end being adapted for attachment to the harness and the opposite end having a terminal eye with an eyehole therein;

a resiliently flexible retaining ring of larger diameter than said eyehole;

said terminal eye being adapted for projection through the ring so that the ring encircles said neck portion;

said ring being compressible to collapse it, after it encircles said neck portion, to a small enough elongated dimension to pass through said eyehole, with one end of the collapsed ring engaging a part of said neck portion adjacent to said terminal eye and the opposite end of the collapsed ring providing a leading tip for guiding the collapsed ring through said eyehole to pull said neck portion part into a coupling loop and through the terminal eye, similarly as a needle passing through a fabric draws a thread through the fabric, and the ring then being permitted to expand to its ring form, and said terminal eye then engaging as a ring-retaining locking collar about said neck portion adjacent said ring and said coupling loop whereby to retain the ring attached to said flexible element;

and the thus retained expanded ring being adapted to fit about and thereby attach an object such as a baby bottle to the harness.

2. A device according to claim 1, including a body encircling harness comprising a body encircling band having opposite end portions provided with means for releasably coupling such end portions together, a pair of shoulder straps having first ends attached to said band in spaced relation at respectively opposite sides of the longitudinal center of the band, said flexible element being attached to said band intermediate said shoulder straps, means on the free end portions of said band for connection the band releasably into loop form, and means on the free end portions of said shoulder straps for attaching such free end portions of the shoulder straps to the body band adjacent to said free end portions of the body band.

3. A device according to claim 2, wherein said fastening means on the body band and on the shoulder straps comprise cooperating loop and hook separable fasteners.

4. A device according to claim 1, comprising:

a body encircling harness band having opposite end portions provided with means for releasably and adjustably coupling such end portions together at the back of the band;

a pair of shoulder straps having first ends attached to the front portion of said band in spaced relation at respectively opposite sides of the longitudinal center at the front of the band;

means on second end portions of the shoulder straps for quick releasably and adjustably coupling them to said end portions at the back of the band;

and said one end of said elongate flexible element connected to substantially said longitudinal center of the front of said band between said first end portions of the shoulder straps.

5. A device according to claim 4, wherein said means for releasably coupling said end portions of the body encircling harness band comprise hook and loop strip fasteners on said end portions, and said means along the second end portions of the shoulder straps for coupling them to said end portions of the band comprising loop and hook separable fastener strips complementary to said fastener strips on said band and separably engageable therewith.

6. A device according to claim 4, wherein said band, shoulder straps and flexible element comprise plastic web material and electronically welded to one another, said means for releasably coupling comprising plastic loop and hook separable fasteners electronically welded onto respectively said band and said shoulder straps.

7. In a method of assembling a device especially suitable for anchoring an object such as a baby bottle or the like to a body encircling harness, and wherein the device has an elongate flexible element having a neck portion and opposite ends, one end being adapted for attachment to the harness and the opposite end having a terminal eye with an eyehole therein:

projecting said terminal eye through a resiliently flexible retaining ring of larger diameter than said eyehole;

compressing and collapsing the ring, after projection therethrough of said terminal eye, to a small enough elongated dimension to pass through said eyehole;

coincident with said compressing and collapsing engaging a part of said neck portion adjacent to said terminal eye within one end of the collapsed ring;

guiding the opposite end of the collapsed ring as a leading tip through said eyehole and drawing the collapsed ring and with it said neck portion part into a coupling loop through said terminal eye, similarly as a needle passing through a fabric draws a thread through the fabric, and then permitting the ring to expand to its ring form;

and after the ring has been permitted to expand to its ring form retaining the ring attached to the flexible element by engagement of said terminal eye as a ring-retaining locking collar about said neck portion adjacent said ring and said coupling loop;

whereby the thus retained expanded ring is adapted to fit about and thereby attach an object such as a baby bottle to the harness.

8. A method according to claim 7, including attaching the opposite end of the flexible element to a body encircling harness band intermediate a pair of shoulder straps having first ends attached to said band in spaced relation at respectively opposite sides of said flexible element, connecting end portions of the band releasably into loop form, and connecting second ends of the shoulder straps releasably to the band adjacent to said end portions of the body band.

9. A method according to claim 8, further including effecting said connecting of said end portions and second ends by pressing together cooperating loop and hook separable fasteners on the body band end portions and on the second ends of the shoulder straps.

10. A method according to claim 7, including engaging said locked and expanded ring about the neck of a baby nursing bottle between the inner end of a nipple attached to the neck and a shoulder on the bottle and thereby anchoring the bottle to the device.

* * * * *